United States Patent [19]

Urquhart et al.

[11] Patent Number: 4,775,454

[45] Date of Patent: Oct. 4, 1988

[54] WORK CARRIER UNIT FOR BULK PROCESSING

[76] Inventors: Thomas N. Urquhart, 3051 Kingsley Dr., Troy, Mich. 48084; Gordon T. Urquhart, 19171 Filmore, Southfield, Mich. 48075

[21] Appl. No.: 628,711

[22] Filed: Jul. 6, 1984

[51] Int. Cl.[4] ..... C25D 17/26

[52] U.S. Cl. ..... 204/201; 204/222

[58] Field of Search ..... 204/212, 213, 198, 199, 204/201, 222, 223

[56] References Cited

U.S. PATENT DOCUMENTS

| | | | |
|---|---|---|---|
| 2,479,323 | 8/1949 | Davis | 204/222 |
| 2,830,946 | 4/1958 | Pleadwell | 204/222 |
| 2,841,547 | 7/1958 | Kotz | 204/223 |
| 3,769,193 | 10/1973 | Gill | 204/222 |
| 3,873,435 | 3/1975 | Ziebarth | 204/222 |

FOREIGN PATENT DOCUMENTS

| | | | |
|---|---|---|---|
| 248419 | 12/1969 | U.S.S.R. | 204/222 |
| 14708 | of 1897 | United Kingdom | 204/222 |

*Primary Examiner*—T. M. Tufariello

*Attorney, Agent, or Firm*—Rogers, Howell, Moore & Haferkamp

[57] ABSTRACT

An apparatus for immersing a plurality of workpieces adapted to be raised and lowered in response to control commands. The apparatus includes a support structure having a plurality of work carrier units rotationally supported thereon. The apparatus further includes means for linking the plurality of work carrier units so that they may be rotated in unison.

13 Claims, 5 Drawing Sheets

FIG. 1
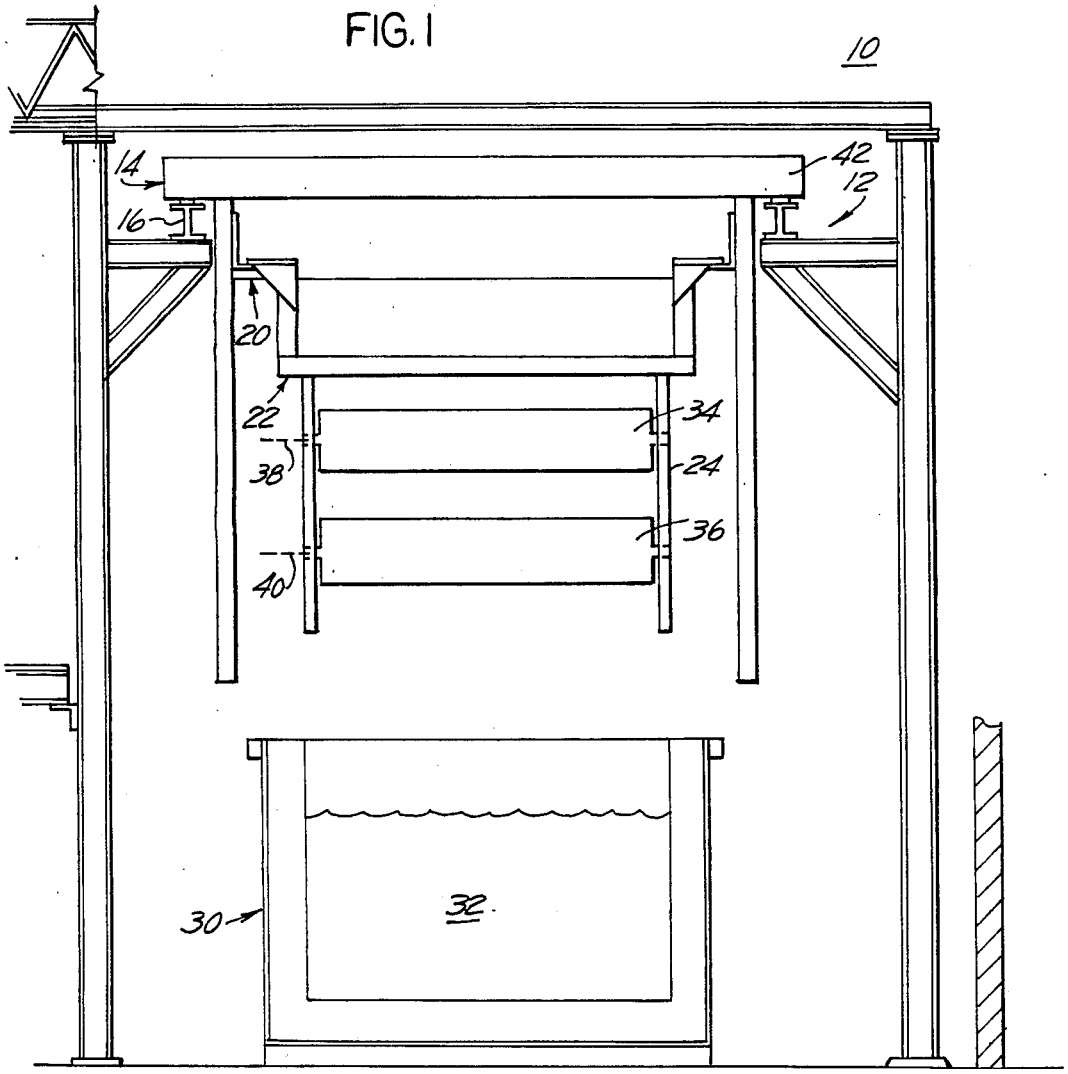
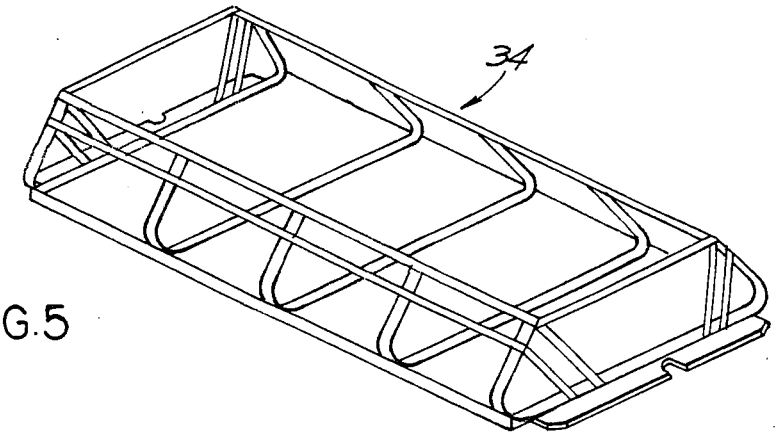
FIG. 5

WORK CARRIER UNIT FOR BULK PROCESSING

BACKGROUND AND SUMMARY OF THE INVENTION

The invention is used to immerse a plurality of workpieces into one of a plurality of workstations and is more particularly related to a work carrier unit for use within an electrodeposition system for simultaneously placing a protective coating on a large number of workpieces.

Our patent application U.S. Ser. No. 551,564 illustrates a system which includes a work carrier unit for immersing a single object such as a car body into the various processing stations of an electrodeposition system. These processing stations may include a prerinse station, a phosphating station, a postrinse station and an electrodeposition station and a heating station. The present invention is more ideally suited to simultaneously applying a protective coating to a large plurality of work pieces, each substantially smaller than the car body mentioned above. It is envisioned that one of the uses of the present invention would be to apply protective coatings to workpieces such as bolts, nails, screws, and to larger workpieces such as brake drums and pulleys, etc.

The present invention permits the mass coating of a large plurality of relatively small workpieces.

It is an object of the present invention to provide means for coating a large plurality of small workpieces.

It is a further object of the present invention to provide a single workpiece carrier that may be used within each of the processing stations of an electrodeposition system.

A further object of the present invention is to provide a work carrier unit for transporting large pluralities of workpieces in and through the various work stations of an electrodeposition system.

Accordingly, the present invention comprises an apparatus for immersing a plurality of workpieces into a work processing station comprising a support structure adapted to be raised and lowered in response to command signals. The apparatus further includes a plurality of work carrier units rotationally linked to the support structure and situated thereon so that when the support structure is lowered said units enter the work processing station and the apparatus further includes means for oscillating the work carrier units about a predetermined axis. The invention further includes means for varying the angle of tilt of the workpiece carriers as they are lowered into and removed from any one of the processing stations. A feature of the present invention is the ability to totally treat the workpieces while they remain in the same basket or workpiece carrier from pretreatment to electropainting and through final curing.

Many other objects and features of the present invention will become apparent in view of the description below.

BRIEF DESCRIPTION OF THE DRAWINGS

In the drawings:

FIG. 1 illustrates a work carrier, crane and superstructure for supporting same.

FIG. 5 illustrates a basket for carrying a plurality of workpieces.

DETAILED DESCRIPTION OF THE DRAWINGS

Figure 2:
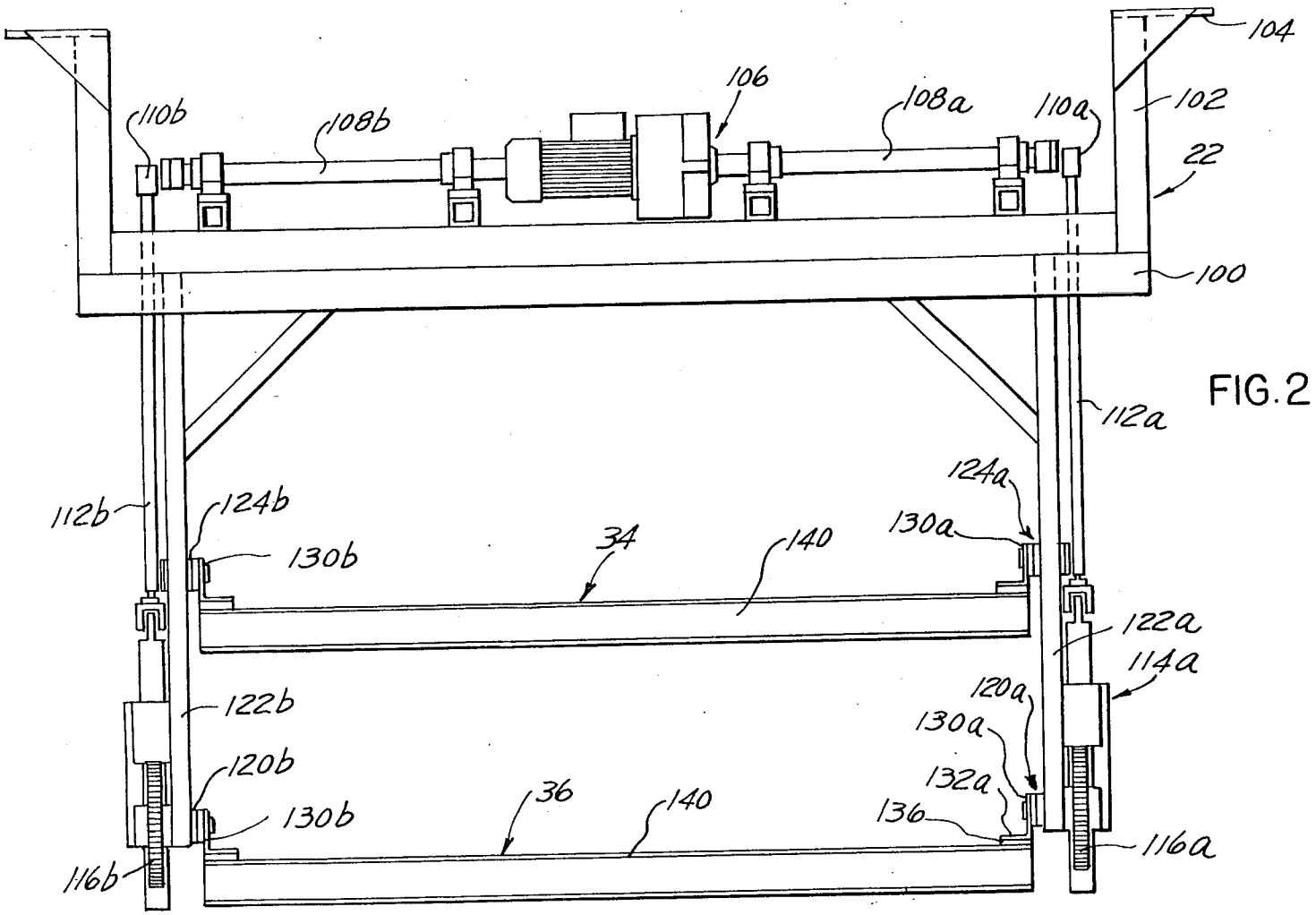
FIG. 2 illustrates a side view of a bulk work carrier.

Reference is made to an electrodeposition system 10 which utilizes the present invention. A similar system is described in greater detail in the above referenced U.S. patent application which is herein incorporated by reference. The system includes a superstructure 12 adapted to support a movable crane 14. The crane 14 is adapted to move on rails generally indicated as 16. As illustrated in FIG. 1, the crane 14 would move into and out from a plane of the FIGURE. The crane 14 includes a plurality of inwardly extending, vertically movable flanges 20 adapted to engage a cooperating portion of the work carrier 22. The system further includes a plurality of process stations 30, only one of which is illustrated in FIG. 1. As discussed in greater detail in the above-mentioned United States patent application, these processing stations 30 may include rinsing, coating and heating stations, etc. The process station, illustrated in FIG. 1, includes solution, generally designated as 32, into which the work carrier unit including its support structure 22 is lowered. The work carrier unit 22 supports a plurality of bulk workpiece carriers, generally designated as 34 and 36. Each workpiece carrier is rotationally linked to the support structure 24 such that it is rotatable about axes 38 and 40. As described in greater detail below, the bulk workpiece carriers 34 and 36 comprise a basket-like structure having a cage or lattice-like construction to permit the relatively unobstructed flow of fluid therethrough. While only two vertically situated workpiece carriers are shown this is not a limitation of the invention. One such workpiece carrier 34 is illustrated in FIG. 5.

In operation the flanges 20 are lowered therein placing the work carrier unit 22 within the processing station, such as station 30. Motors housed in the upper portion, generally designated as 42, of the work carrier 22 are used to turn, tilt or oscillate the bulk workpiece carriers 34 and 36. This upper portion 42 may be enclosed to protect the motors.

Figure 3:
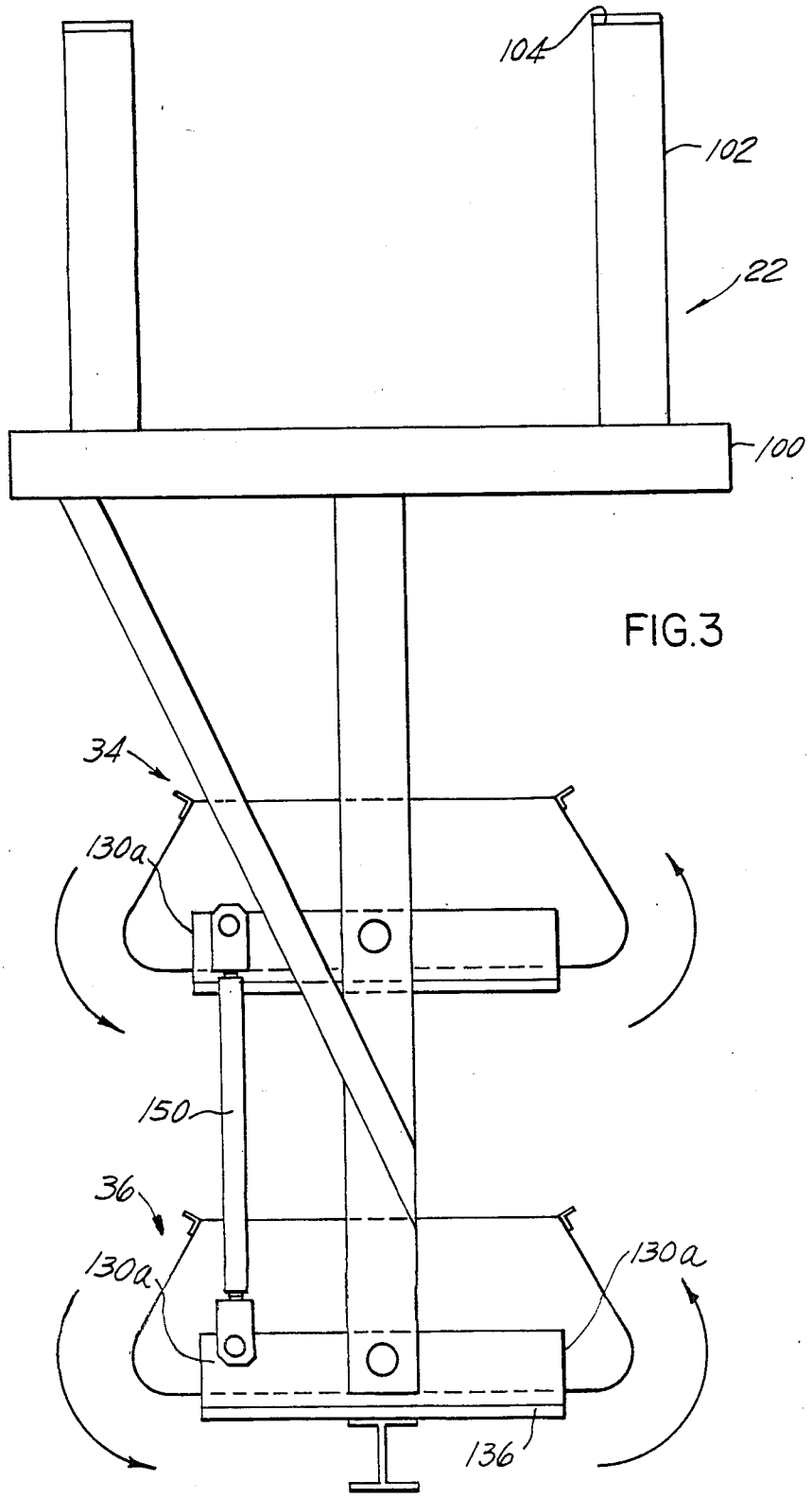
FIG. 3 illustrates a side view of a work carrier.
Figure 4:
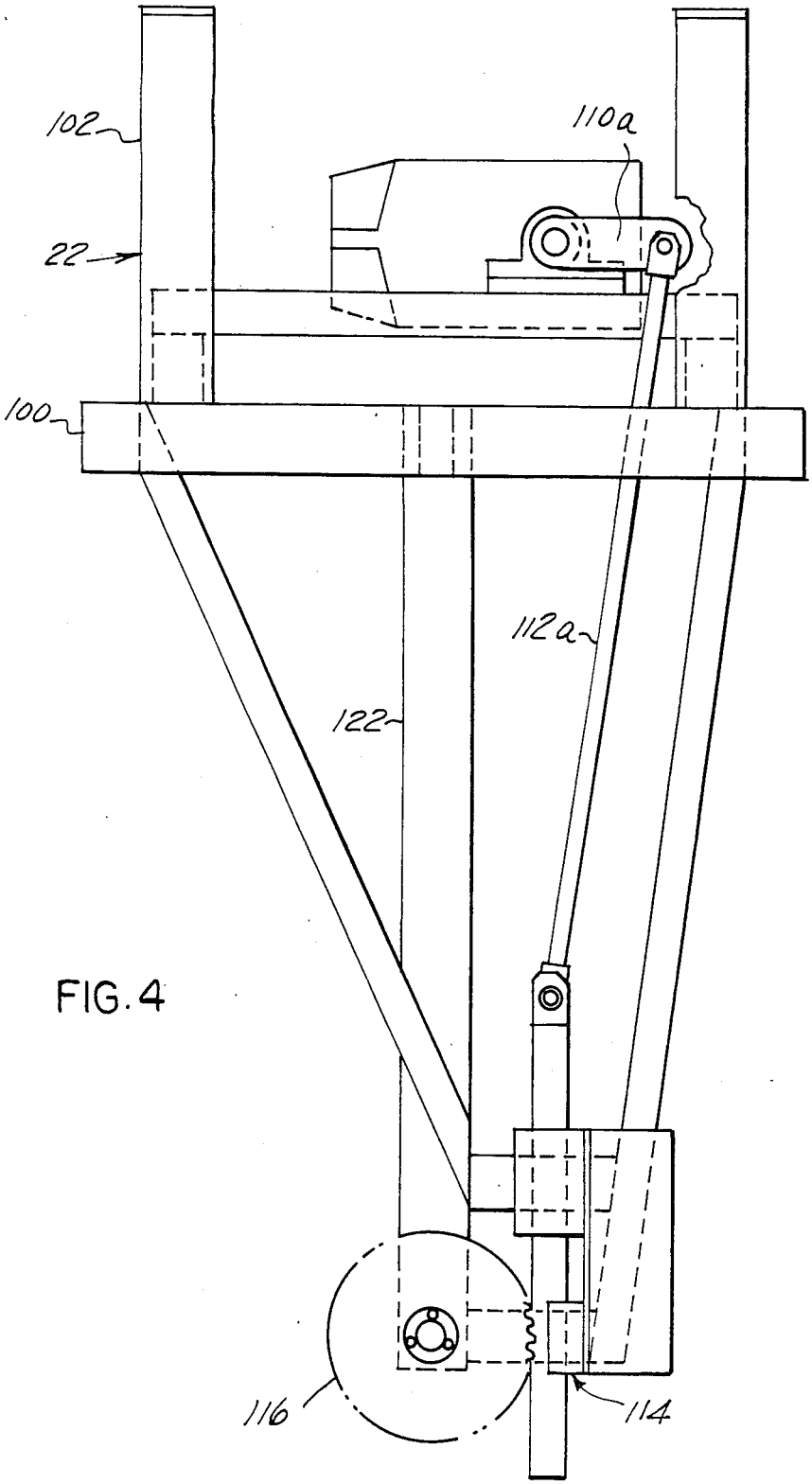
FIG. 4 illustrates another side view of the work carrier.

Reference is now made to FIGS. 2, 3 and 4.

FIG. 2 illustrates a detailed, side view of the workpiece carrier 22.

FIG. 3 illustrates a side view of the work carrier 22 illustrating the relationship between the work carrier support members and workpiece carriers or baskets 34 and 36. For the sake of clarity FIG. 3 does not contain reference to motors and gear linkages which are used to rotate or oscillate the bulk workpiece carrier. The relationship of the motors and gearing utilized to rotate the bulk workpiece carriers are illustrated in FIG. 4. Again for the sake of clarity the baskets have been removed from FIG. 4.

Each workpiece carrier unit 22 comprises a roof 100. Extending upwardly from the roof 100 are four posts 102. Extending outwardly from the top of each post 102 is a flange 104 of sufficient length to engage the inwardly directly flanges 20 of the crane 14 as illustrated in FIG. 1. Fitted to and carried by the roof 100 is a motor, transmission and gear unit 106 of a known variety as shown in FIG. 2. The unit 106 includes at least one axially extending shaft 108*a*. An upper link arm 110*a* is attached to the shaft 108*a*. A lower link arm 112*a* is attached to and is movable by the upper link arm 110*a*. The lower link arm 112*a* moves a rack and pinion mechanism 114*a* comprising a spur gear 116*a*. The gear 116*a* is directly connected to a first workpiece carrier 36 through a bushing or bearing 120*a* of a known variety. The workpiece carrier 36 is additionally supported by a bearing 120*b*. The gear 116*a* and bearing 120*a* and bearing 120*b* are supported by a pair of vertical support members 122*a* and *b* which extend from the roof 100.

As illustrated in the accompanying figures, the workpiece carrier 34 and 36 can be driven by a pair of gears 116*a* and *b*, lower links 112*a* and *b*, etc., upper links 110*a* and *b* and shafts 108*a* and *b*, etc. This dual drive relationship is not a requirement of the invention.

A second bulk workpiece carrier 34 is attached to the supports 122*a* and *b* through bushings or bearings 124*a* and *b* in the manner as described for the carrier 36. Each support 122 comprises at its ends, proximate the bushings 120 and 124, a transverse member 130*a* and *b*. This relationship is shown in FIGS. 2 and 3. These members 130 contain an inwardly directed flange 132 which is attached to another laterally extending member 136. This member 136 is attached to an axially extending member such as I beam 140. The carriers 34 and 36 are adapted to seat upon and be carried by the platform formed by the members 130, 136 and the I beam 140. A pivotable link 150 of a known variety is attached to the flanged members 130*a* and *b*. The attachment of members 130*a* and *b* is illustrated only in FIG. 3. The link 150 transmits the rotary motion of the lower carrier 36 to the upper carrier 34. The baskets 34 and 36 maay comprise a structure having open or lattice-like walls, ends and bottoms to permit the free flow of solution therethrough as shown in FIG. 5. In addition, if the workpieces to be received into the workpiece carriers are relatively large, the workpiece carriers may include a rack to maintain each of the workpieces in a preferred orientation therein or such workpieces may be fitted within slots, holders or the like within each workpiece carrier.

In operation, the workpieces, such as a large plurality of bolts or nails, etc., will be randomly placed into the workpiece carriers 34 and 35 or, alternatively, if larger workpieces are utilized they will be stacked in a preferred orientation therein. The work carrier unit 22 is transported by the cranes 14 to an appropriate work processing station 30 where the workpieces may be spray rinsed, immersed in solution, heated, cured, etc. Upon being lowered into the work processing station 30, the workpiece carriers may be oscillated therein within solution, relative to a spray, or relative to the hot air currents within a heating or curing cell to expose a greater surface area of the workpieces to the rinsing agents, solution or heated airstream. If power is available to the motor and gear units 106, the baskets 142 may be oscillated while the work carrier 22 is suspended above a process station or while it has been lowered therein.

In addition, the individual workpiece carriers may be tilted or rotated to a predetermined and variable angle prior to insertion within or upon withdrawal from a solution such as an electrodepositin solution. This tilting reduces bouyancy problems upon insertion and aids in drainage upon withdrawal. Further, each workpiece carrier may be oscillated while in solution through a predetermined profile over a predetermined interval. This oscillation greatly enhances workpiece coverage by the electrodeposition solution resulting in improved parts with greater yield. As an example, each workpiece carrier may be oscillated over a predetermined angular range at set times. In addition, it is contemplated the workpiece carriers will be oscillated after entry into processing stations other than an electrodeposition or electropainting processing station. This provides greater exposure of the workpieces to sprays which may be used during prerinse and post rinse and greater exposure to hot air currents during curing within an oven. It is not a requirement that each workpiece carrier 34 and 36 be rotated in phase. They may be counter-rotated by appropriate gearing depending upon the specific application.

Figure 6:
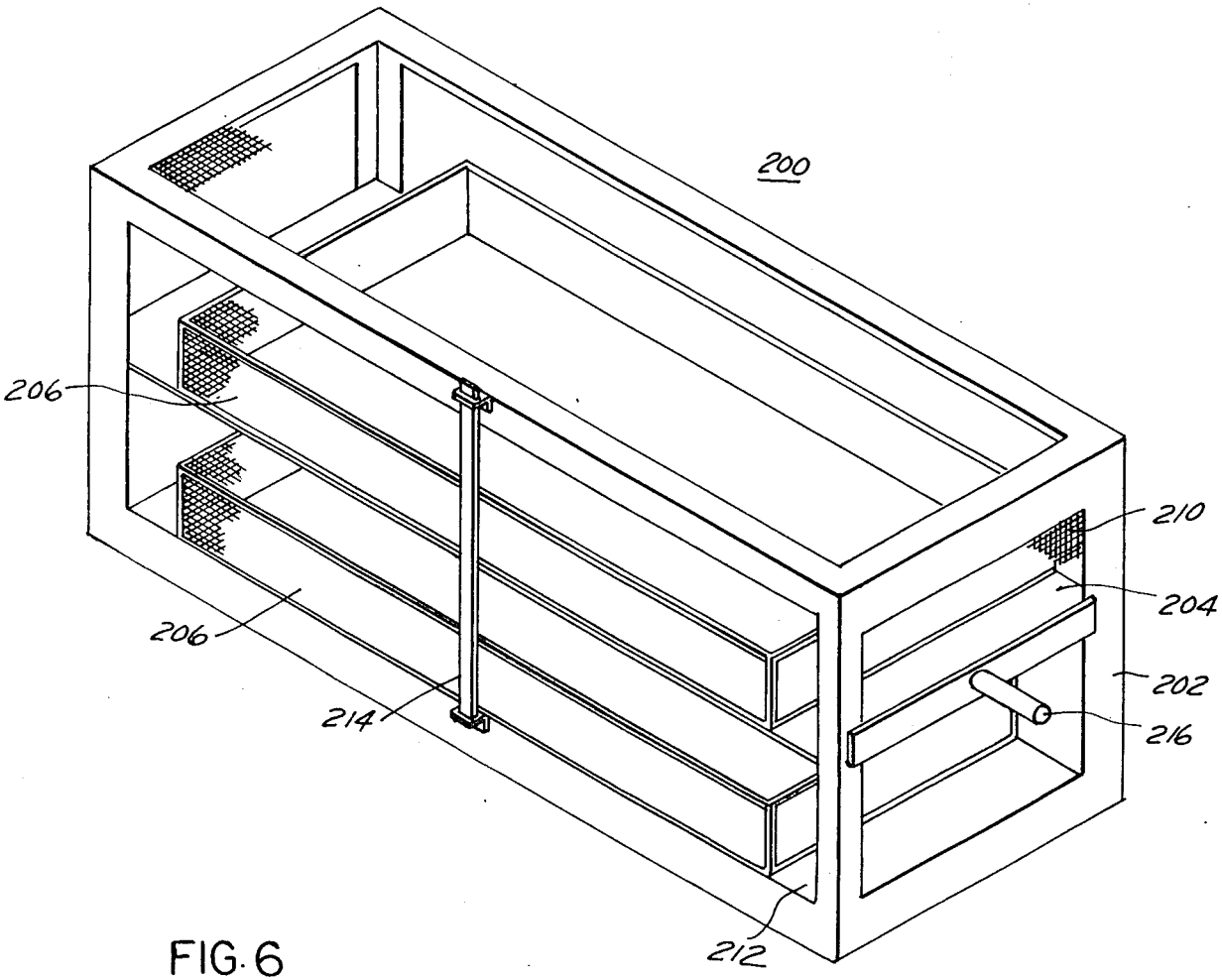
FIG. 6 illustrates as alternate embodiment of the invention.

FIG. 6 illustrates as alternate embodiment of the invention. There is illustrated a multi-basket (mult-workpiece carrier) or common carrier 200. The carrier 200 comprises a box-like structure defining a frame 202 which supports a plurality of shelves 204. Resting upon each shelf 204 is a basket 206 such as a wire mesh basket which holds a plurality of workpieces (not shown). The basket 206 is substantially open to permit fluid flow while sufficiently closed to support the workpieces. The frame may further support a wire mesh 210, bars, ribs or the like which prevent the baskets 206 from becomming dislodged but still permit fluid to enter therein. The carrier 200 further includes means for locking each basket 206 in placed within the frame 202 such that the baskets 206 cannot slide out of the open end 212 thereof. Such locking means can include clasps, snaps, a cover or a bar 214 rotatably secured to the frame 202. The frame 202 may further support shafts 216 extending therefrom which are rotationally supported by the supports 122 of the crane 14. In this manner the carrier 200 and the baskets 206 therein may be rotated, tilted and oscillated by gearing such as 114 and 116 in a manner as described above.

Many changes and modifications in the above-described embodiment of the invention can, of course, be carried out without departing from the scope thereof. Accordingly, that scope is intended to be limited only by the scope of the appended claims.

Having thus described the invention what is claimed is:

1. An apparatus for immersing a plurality of workpieces into a workstation comprising:

a support structure adapted to be raised and lowered in response to command signals;

a plurality of workpiece carriers rotationally linked to said support structure and situated thereon including a plurality of workpiece carriers comprising a plurality of vertically stacked baskets received within cooperating shelves; and means for rotating said workpiece carriers including means for oscillating said workpiece carriers in unison.

2. The apparatus as defined in claim 1 wherein said last-named means comprises a link connecting adjacent workpiece carriers.

3. The apparatus as defined in claim 2 wherein said workpiece carriers comprise a basket-like structure having partially open or slotted sides, ends and bottom.

4. The apparatus as defined in claim 2 wherein said means for rotating includes a motor and gears carried by said support structure and linked to at least one of said workpiece carriers.

5. The apparatus as defined in claim 3 wherein said plurality of workpieces are received in a predetermined orientation.

6. The apparatus as defined in claim 1 wherein said workpiece carriers comprise a substantially rectangular frame including an open side and supporting a plurality of spaced shelves for slidably receiving a respective basket thereon, said open side and said spacing sufficient to permit receipt of said respective basket.

7. The apparatus as defined in claim 6 wherein said frame further includes means for securing said baskets therein.

8. The apparatus as defined in claim 7 wherein said means for securing includes a bar movably secured across said open side of said frame.

9. An apparatus for use within an electrodeposition system comprising:

a plurality of rotatable platforms defining a plurality of vertically stacked shelves;

means for suspending and translating said plurality of platforms;

means cooperating with said means for suspending and translating for rotating said platforms in unison; and means supported by each of said platforms for receiving a plurality of workpieces including a plurality of open baskets, each basket adapted to be received on a respective one of said shelves.

10. The apparatus as defined in claim 9 wherein said means for rotating said platforms comprises a pivotable link connecting said platforms for transmitting the rotation of one of said platforms to at least a second of said platforms.

11. The apparatus as defined in claim 9 wherein said platforms are vertically orientated one to another.

12. The apparatus as defined in claim 1 wherein said plurality of workpiece carriers are received within a common carrier and wherein said means for rotating includes means for rotating said common carrier about a predetermined axis.

13. The apparatus as defined in claim 12 wherein said plurality of workpiece carriers are received as drawers within cooperating shelves of said common carrier.

* * * * *